US010400381B2

(12) United States Patent
Lee

(10) Patent No.: US 10,400,381 B2
(45) Date of Patent: Sep. 3, 2019

(54) LIQUID ADDITIVE SUPPLY DEVICE FOR WASHING MACHINE

(71) Applicant: Dongbu Daewoo Electronics Corporation, Seoul (KR)

(72) Inventor: Jong Jin Lee, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 249 days.

(21) Appl. No.: 15/265,739

(22) Filed: Sep. 14, 2016

(65) Prior Publication Data

US 2017/0233932 A1 Aug. 17, 2017

(30) Foreign Application Priority Data

Feb. 16, 2016 (KR) ..... 10-2016-0017550

(51) Int. Cl.
*D06F 39/02* (2006.01)
*D06F 39/12* (2006.01)

(52) U.S. Cl.
CPC ..... *D06F 39/022* (2013.01); *D06F 39/12* (2013.01)

(58) Field of Classification Search
None
See application file for complete search history.

(56) References Cited

U.S. PATENT DOCUMENTS 5,836,180 A * 11/1998 Herman-Latack ..... D06F 39/02 68/17 R
2006/0144424 A1* 7/2006 Marchitto ..... A47L 15/4409 134/25.2
2015/0143856 A1 5/2015 Jo et al.
2016/0194810 A1* 7/2016 Jo ..... D06F 39/02 68/17 R

FOREIGN PATENT DOCUMENTS

CN 104674513 A 11/2013
CN 104674513 A 6/2015

* cited by examiner

*Primary Examiner* — Jason Y Ko
*Assistant Examiner* — Cristi J Tate-Sims

(57) ABSTRACT

A liquid additive supply device on a washing machine. The liquid additive supply device includes a main storage part coupled to a cover through a one-touch type of push button. In an assembled state, the push button securely locks the cover to the main storage part. When a user pushes the push button, the cover is released from the locked position and can be separate from the main storage part. The cover includes a movable portion and a fixed portion.

10 Claims, 8 Drawing Sheets

LIQUID ADDITIVE SUPPLY DEVICE FOR WASHING MACHINE

CROSS-REFERENCE TO RELATED APPLICATIONS

This application is based on and claims priority from Korean Patent Application No. 10-2016-0017550, filed on Feb. 16, 2016, the disclosure of which is incorporated herein in its entirety by reference.

TECHNICAL FIELD

The present disclosure relates to washing machines, and more particularly, to liquid additive supply devices for washing machines.

BACKGROUND

In general, detergent is added to washing machines and dispensed for washing laundry during washing cycles. A washing machine typically uses a detergent dispenser to supply and dispense detergent to the washing machine. The detergent dispenser has a drawer-type detergent supply device. A user can pull out the detergent supply device partially to add detergent.

As extraneous material such as dust or the like is likely introduced into the detergent supply device together with the detergent, detergent residue can build up in the detergent supply device. Especially after a long period of non-use, the residue tends to become stuck in the detergent supply device. In a conventional detergent dispenser, the detergent supply device is not designed to be detached from the detergent dispenser by a user, making it difficult to clean the detergent residue at the bottom of the detergent supply device.

PRIOR ART DOCUMENTS

Patent Documents

Patent Document: Korean Patent Application Publication No. 10-2010-0042985 (published on Apr. 27, 2010)

SUMMARY

Embodiments of the present disclosure provide a liquid additive supply device that can be easily removed from and attached back to the detergent dispenser on a washing machine by a user. Thereby, a user can advantageously clean the liquid additive supply device conveniently.

According to an embodiment of the present disclosure, a liquid additive supply device for a washing machine including a liquid additive dispenser having an accommodation part includes: a main body removably accommodated within the accommodation part and configured to store a liquid additive; a cover part configured to cover a top opening of the main body; and a retainer configured to securely attach the cover part to the main body.

According to another embodiment of the present disclosure, a liquid additive supply device for a washing machine including a liquid additive dispenser having an accommodation part includes: a main body removably accommodated within the accommodation part and configured to store a liquid additive; a cover part configured to cover a top of the main body; and a push button coupled to the main body. The push button at a first position is operable to securely couple the cover part to the main body. The push button at a second position is operable to release the cover part from the main body.

According to still another embodiment of the present disclosure, a washing machine includes: a liquid additive dispenser including an accommodation part and a liquid additive supply device removably accommodated within the accommodation part. The liquid additive supply device includes: a main body removably accommodated within the accommodation part and configured to store a liquid additive; a cover part configured to cover a top of the main body; and a push button coupled to the main body. The push button at a first position is operable to securely couple the cover part to the main body. The push button at a second position is operable to release the cover part from the main body.

DETAILED DESCRIPTION

Figure 1:
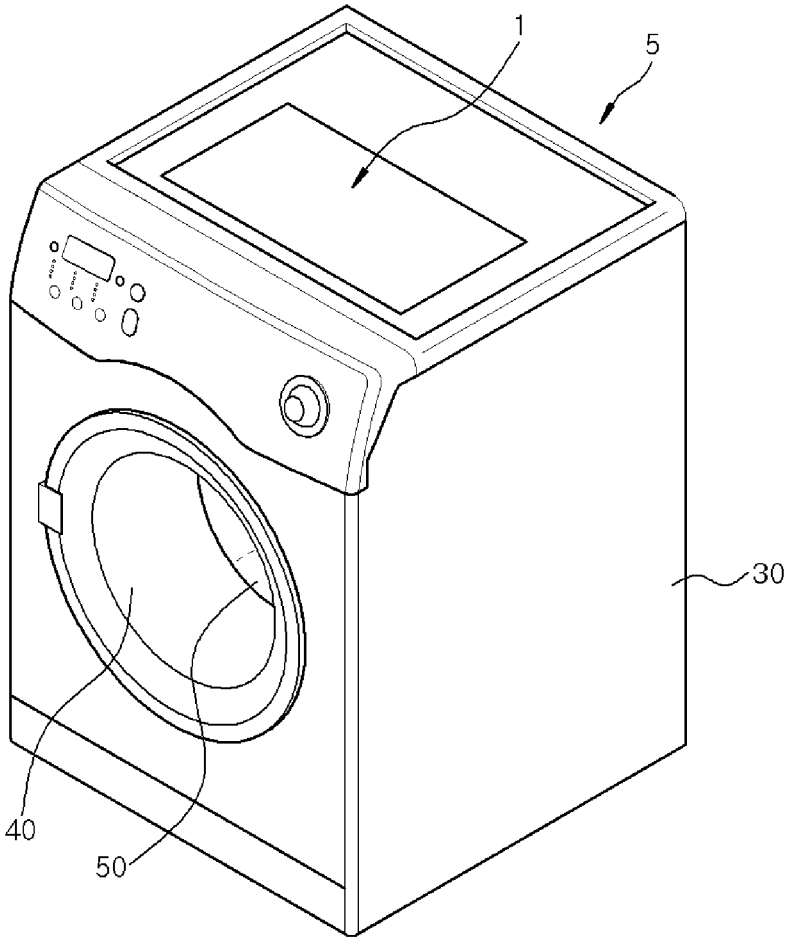
FIG. 1 illustrates a perspective view of an exemplary washing machine according to one embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in their sizes, and a predetermined size is just exemplificative and not limitative. The same reference numerals designate the same structures, elements, or parts illustrated in two or more drawings in order to exhibit similar characteristics.

The exemplary embodiments of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of a form by manufacturing.

Figure 2:
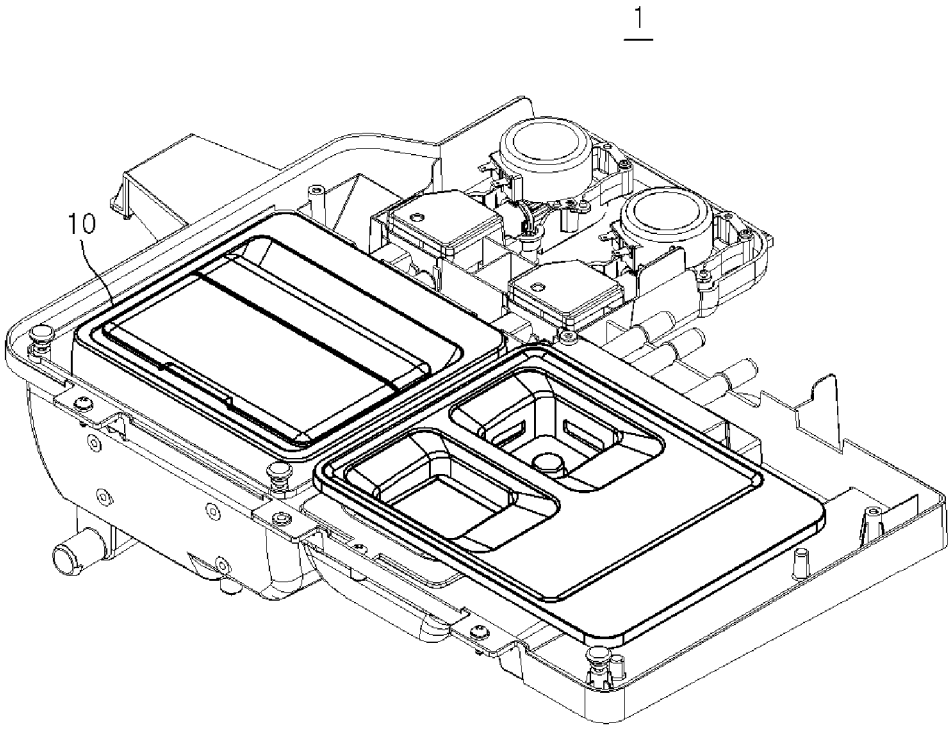
FIG. 2 illustrates an assembled perspective view of an exemplary liquid additive supply device for a washing machine according to one embodiment of the present disclosure.
Figure 3:
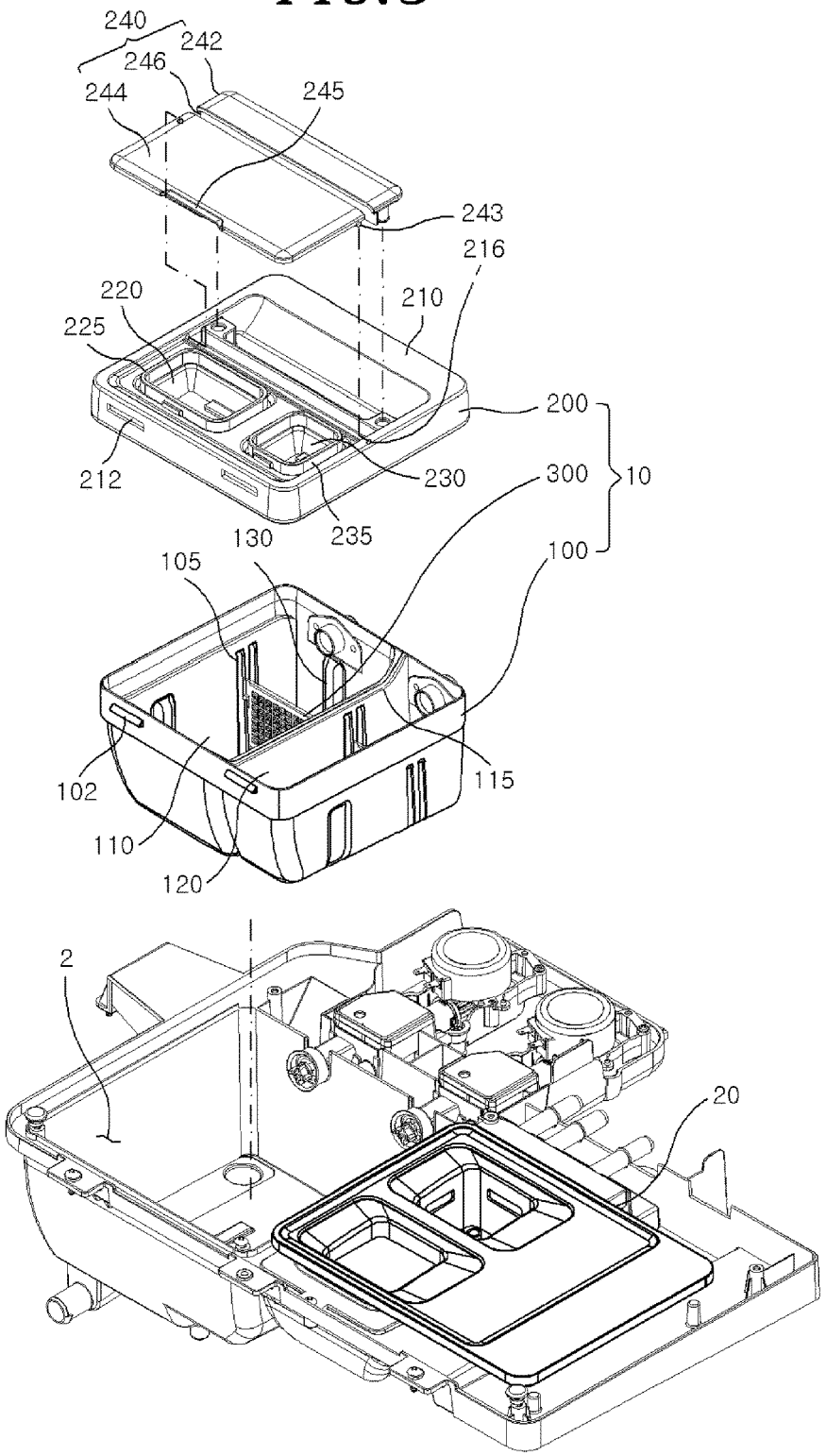
FIG. 3 illustrates an exploded perspective view of the exemplary liquid additive supply device for a washing machine according to one embodiment of the present disclosure.
Figure 4A:
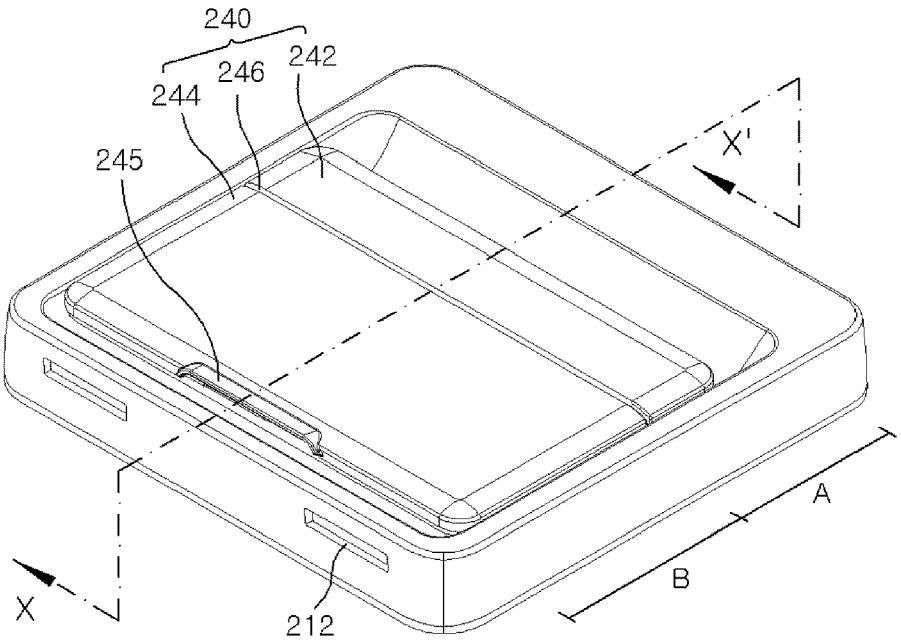
FIG. 4A illustrates a perspective view of an exemplary cover part of the liquid additive supply device for a washing machine according to one embodiment of the present disclosure.
Figure 4B:
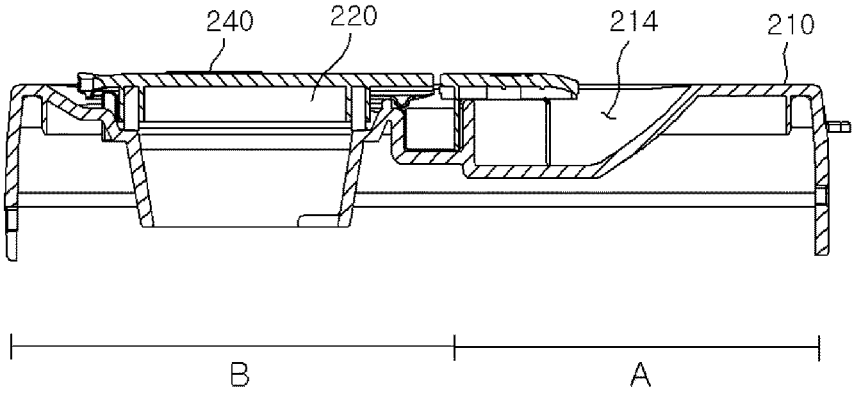
FIG. 4B is a sectional view taken along line X-X' in FIG. 4A.
Figure 5:
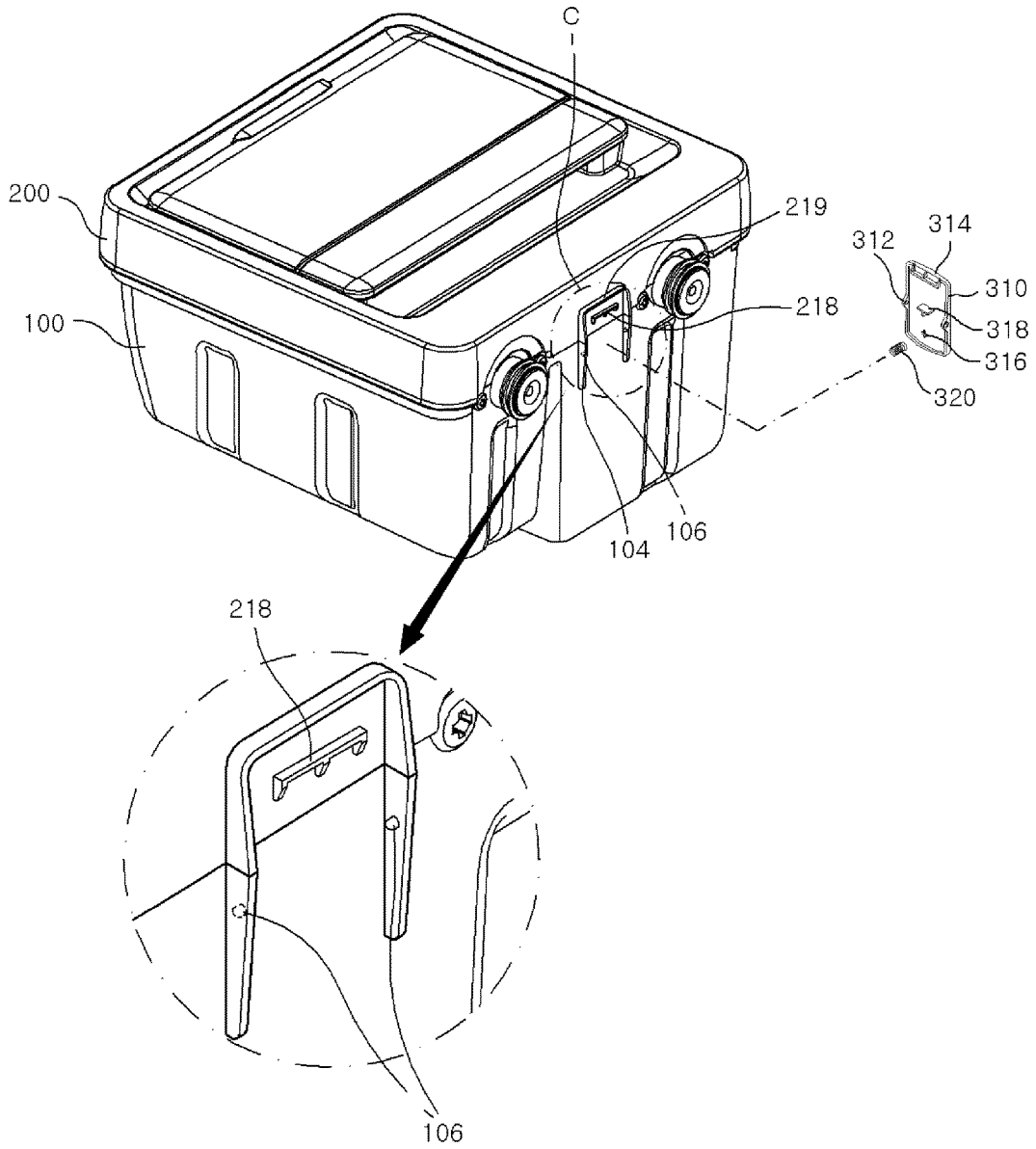
FIG. 5 illustrates an exploded perspective view of an exemplary retainer of the liquid additive supply device for a washing machine according to one embodiment of the present disclosure.
Figure 6:
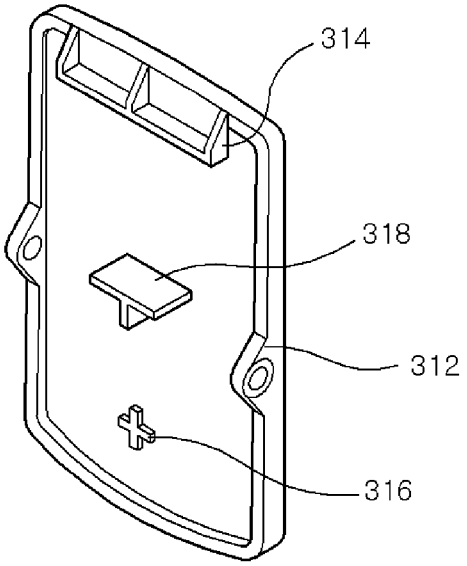
FIG. 6 illustrates a perspective view of a push button of the exemplary retainer of the liquid additive supply device for a washing machine according to one embodiment of the present disclosure.

FIG. 1 illustrates a perspective view of an exemplary washing machine according to one embodiment of the present disclosure. FIG. 2 illustrates an assembled perspective view of an exemplary liquid additive supply device for a washing machine according to one embodiment of the present disclosure. FIG. 3 illustrates an exploded perspective view of the exemplary liquid additive supply device for a washing machine according to one embodiment of the present disclosure. FIG. 4A illustrates a perspective view of an exemplary cover part of the liquid additive supply device for a washing machine according to one embodiment of the present disclosure. FIG. 4B is a sectional view taken along line X-X' in FIG. 4A. FIG. 5 illustrates an exploded perspective view of an exemplary retainer of the liquid additive supply device for a washing machine according to one embodiment of the present disclosure. FIG. 6 illustrates a perspective view of a push button of the exemplary retainer of the liquid additive supply device for a washing machine according to one embodiment of the present disclosure.

Referring first to FIG. 1, the washing machine 5 includes a cabinet 30, a tub 40, a drum 50 and a detergent dispenser (i.e., a liquid additive dispenser) 1. The washing machine 5 may be a drum type washing machine having a rotatable drum 50. However, the washing machine 5 is not limited to any specific type.

The cabinet 30 includes an exterior housing of the washing machine 5. The tub 40, the drum 50 and the like may be installed within the cabinet 30. The detergent dispenser 1 may be assembled at the top (i.e., top opening) of the cabinet 30.

In addition to the tub 40, the drum 50 and the detergent dispenser 1, various other components of different functions may be enclosed in the cabinet 30. For example, in the cabinet 30, there may be installed a detergent supply pipe (not shown) configured to couple the detergent dispenser 1 to the tub 40, so that the detergent contained in the detergent dispenser 1 can be carried and dispensed to the tub 40. An electric motor may be configured to provide power to the drum 50. A water supply device (not shown) may be used to supply washing water into the tub 40. A drying device (not shown) may be used to dry the objects (e.g., laundry) inside the tub 40. A drain device (not shown) may be configured to drain the washing water outside the cabinet 30.

The tub 40 has a cylindrical structure used to accommodate washing water. It is horizontally positioned within the cabinet 30. The tub 40 may receive detergent from the detergent dispenser 1, may receive washing water from the water supply device. Washing water can be drained from the tub 40 to the outside of the cabinet 30 through the drain device.

The drum 50 may be rotatably installed inside the tub 40 and coupled to a motor. The drum 50 can contain laundry or other washing objects during operation. The laundry is stirred with the rotation of the drum 50 and washed with the washing water and detergent supplied into the tub 40.

The detergent dispenser 1 may include an accommodation part 2, a liquid additive supply device 10 removably accommodated within the accommodation part 2 and a preliminary additive supply device 20 integrally formed with the detergent dispenser 1.

Referring to FIGS. 2 to 6, the liquid additive supply device 10 may include: a main body 100 removably accommodated within the accommodation part 2 and configured to store a liquid additive; a cover part 200 configured to cover the top of the main body 100, and a retainer 300 configured to retain the cover part 200 to the main body 100 in an assembled position.

The liquid additive supply device 10 can be used to contain a liquid additive (e.g., liquid detergent or fabric softener) to be supplied to the tub 40 during a washing cycle. Furthermore, the preliminary additive supply device 20 can contain another additive, for example preliminary additive (e.g., powdery detergent or preliminary fabric softener,) to be supplied to the tub 40 during a washing cycle. A preliminary additive may be used when the liquid additive supply device 10 is separated from the accommodation part 2 of the detergent dispenser 1.

Since the detergent dispenser 1 extends along the width of the cabinet 30 (e.g., the left-right direction of the cabinet 30 when the washing machine is positioned for operation) at the top of the cabinet 30, the liquid additive supply device 10 and the preliminary additive supply device 20 have relatively large capacities for a liquid additive and a preliminary additive.

Hereinafter, descriptions will be directed primarily to the liquid additive supply device 10 that is removably accommodated within the accommodation part 2 of the detergent dispenser 1.

The main body 100 may include two storages parts, for example a first storage part 110 for containing a first additive (e.g., liquid detergent), and a second storage part 120 for containing a second additive (e.g., fabric softener for example). Hereinafter embodiments are described using a liquid detergent storage part 110 and a fabric softener storage part 120 as an example, but the present disclosure is not limited to any specific type of additives that can be added in the storages parts 110 and 120.

A nozzle 130 in the main body 100 receives liquid additives from the liquid detergent storage part 110 and the fabric softener storage part 120 and carries the liquid additives upward from the lower portion of the main body 100 to the upper portion thereof.

In this case, the bottom wall of the main body 100 may be downwardly inclined from a front region (where the liquid additives are supplied) toward a rear region where the nozzle 130 is positioned. In this way, the liquid additives can flow under gravity in the main body 100, which prevents the liquid additives from sticking to the lower portion of the main body 100 as would occur if the liquid additives remain static.

A filter 135 having a removable structure may be mounted within the main body 100. The filter 135 can filter dust or other extraneous material mixed in the liquid additives (e.g., which may be introduced inadvertently or for instance by a child), thereby preventing the nozzle 130 from becoming clogged by the dust or the extraneous material.

The liquid detergent storage part 110 and the fabric softener storage part 120 may be partitioned by a partition wall 115. Thus, the liquid detergent stored in the liquid detergent storage part 110 and the fabric softener stored in the fabric softener storage part 120 may be used as a main liquid detergent and a main fabric softener, respectively.

Liquid detergent or any other suitable liquid additive may be stored in the liquid detergent storage part 110. A large supply of liquid detergent useful for multiple washing operations may be stored in the liquid detergent storage part 110.

Fabric softener or any other suitable liquidate additive may be stored in the fabric softener storage part 120. A large supply of fabric softener for multiple washing operations may be stored in the fabric softener storage part 120.

In general, a larger amount of liquid detergent is used than fabric softener during washing. Thus, the height of the liquid detergent storage part 110 may be configured larger than the height of the fabric softener storage part 120. In other words, the liquid detergent storage part 110 may be larger than the fabric softener storage part 120. However, this discussion is nothing more than exemplary and may be modified without departing from the scope of the present disclosure.

The nozzle part 130 may be installed in each of the liquid detergent storage part 110 and the fabric softener storage part 120. Furthermore, the nozzle part 130 may be coupled to a suction pump (not shown). During a washing operation, the liquid additives may be carried upward from the lower portion of the main body 100 to the upper portion thereof through the nozzle part 130. Thus, even if the main body 100 is separated from the accommodation part 2 of the detergent dispenser 1, the liquid additives contained in the main body 100 do not flow outward.

The cover part 200 can cover the upper portion of the main body 100. The cover part 200 may include: a main cover 210 provided with a knob portion having a knob groove 214 and a detergent supply portion for supplying the liquid additives; a liquid detergent supply hole (i.e., a first liquid additive supply hole) 220 in the detergent supply portion of the main cover 210 and configured to supply the liquid detergent; a fabric softener supply hole (i.e., a second liquid additive supply hole) 230 in the detergent supply portion of the main cover 210 which is configured to supply the fabric softener; and an auxiliary cover 240 coupled to the main cover 210 and configured to open or close the liquid detergent supply hole 220 and the fabric softener supply hole 230. The fabric softener supply hole 230 is spaced apart from the liquid detergent supply hole 220.

The main cover 210 may be the main body of the cover part 200. A knob groove 214 is formed in the knob portion A of the main cover 210 (see FIG. 4B). A user can put a hand in the knob groove 214 to lift up the liquid additive supply device 10, thereby removing it from the accommodation part 2 of the detergent dispenser 1.

A locking slot 212 may be formed on at least one side surface of the main cover 210. A locking tab 102 formed on at least on one outer surface of the main body 100 can be inserted (e.g., snapped) into the locking slot 212. As the locking tab 102 of the main body 100 and the locking slot 212 of the main cover 210 are coupled together, the main body 100 and the main cover 210 may be securely coupled to each other.

The liquid detergent supply hole 220 is covered by the auxiliary cover 240. Liquid detergent can be added through the liquid detergent supply hole 220 and stored in the liquid detergent storage part 110. A first gasket 225 is disposed along the outer circumferential surface of the liquid detergent supply hole 220 to seal the gap between the auxiliary cover 240 and the liquid detergent supply hole 220. This can prevent liquid detergent from overflowing from the liquid detergent supply hole 220.

The fabric softener supply hole 230 is covered by the auxiliary cover 240. Fabric softener can be added through the fabric softener supply hole 230 and stored in the fabric softener storage part 120. A second gasket 235 is formed along the outer circumferential surface of the fabric softener supply hole 230 to seal the gap between the auxiliary cover 240 and the fabric softener supply hole 230. This can prevent fabric softener from overflowing from the fabric softener supply hole 230.

The auxiliary cover 240 may include a fixed portion 242 coupled to one side of the knob portion A of the main cover 210, and a rotatable portion 244 coupled to an edge of the fixed portion 242 and can be rotatably coupled to the main cover 210. The auxiliary cover 240 may include a folding portion 246 disposed between the fixed portion 242 and the rotatable portion 244. The rotatable portion 244 may rotatably coupled to the fixed portion 242 via the folding portion 246.

The fixed portion 242 may be threadedly coupled to one side of the knob portion A of the main cover 210.

The rotatable portion 244 may extend from the fixed portion 242 and integrally formed with the fixed portion 242. Alternatively, the rotatable portion 244 may be manufactured as a separate part and integrated with the fixed portion 242 through the folding portion 246. A protrusion portion 245 can be used by a user to lift up the rotatable portion 244 and may be disposed at the free end of the rotatable portion 244. In addition, insertion tabs 243 may be formed at the left and right sides of the rotatable portion 244 adjoining the folding portion 246. The insertion tabs 243 may be rotatably inserted into the insertion grooves 216 formed in the main cover 210.

The folding portion 246 may be injection-molded in a thickness smaller than the thickness of the fixed portion 242 and the rotatable portion 244. Thus, the folding portion 246 can be folded more easily than the fixed portion 242 and the rotatable portion 244. In other words, the rotatable portion 244 of the auxiliary cover 240 is rotatable about the folding portion 246. When the rotatable portion 244 rotates (or pivots), the liquid detergent supply hole 220 and the fabric softener supply hole 230 may be exposed to a user. However, this discussion is nothing more than one example. The folding portion 246 may be coupled with a separate hinge shaft (not shown) and may be folded through the hinge shaft.

The retainer 300 may be of a one-touch type. When the cover part 200 covers the main body 100, the retainer 300 may retain the cover part 200 to the main body 100, otherwise, the cover part 200 can be separated from the main body 100.

The retainer 300 may include a push button 310 and an elastic member 320 configured to resiliently support the push button 310 so that the push button 310 returns to an original position upon a pressure applied to the push button 310 being released.

Insertion slots 312 may be formed at the left and right sides of the push button 310. Insertion tabs 106 formed in a pair of support ribs 104 may be disposed at the other side of the main body 100.

More specifically, when a user presses the lower end of the push button 310, the push button 310 may pivot about the insertion slots 312 with the lower end of the push button 310 moving toward the main body 100 and the upper end moving away from the main body 100. However, this discussion is nothing more than one example. In some other embodiments, the push button 310 may be configured to pivot in an opposite way.

A seating tab 314 may be formed in the upper portion of the push button 310. The seating tab 314 may be coupled to a seat 218 formed at the other side of the cover part 200. The push button 310 is resiliently supported by the elastic member 320 and is biased so it can return to an original position. In the assembled state (e.g., when the cover part 200 is locked to the main body), the seating tab 314 is coupled with the seat 218. When a user presses the lower end of the push button 310, the lower end of the push button 310 may move toward the main body 100 and the upper end of the push button 310 may move away from the main body 100. Thus, the seating tab 314 may be unseated from the seat 218, thereby releasing the cover part 200 from the main body 100.

In addition, an elastic member support tab 316 that can be coupled with the elastic member 320 may be formed in the lower portion of the push button 310. In this case, the elastic member support tab 316 may be formed in any suitable shape, for example, a cross shape. The elastic member 320 may be affixed to the outer circumferential surface of the elastic member support tab 316.

Furthermore, a reinforcing tab 318 may be formed in the center of the push button 310. A protrusion rib 219 for contacting with the upper ends of the support ribs 104 may be formed on one side surface of the cover part 200. The reinforcing tab 318 is used to reinforce the mechanical strength of the push button 310. The protrusion rib 219 and the support ribs 104 may define a space for the push button 310 to be mounted.

The elastic member 320 may be disposed between the main body 100 and the push button 310. For example, one end of the elastic member 320 may be attached to the main body 100. The other end of the elastic member 320 may be affixed to the elastic member support tab 316.

When a user pushes the push button, 310, the elastic member 320 may resiliently interact with the push button 310. When the user releases the pressure, the push button 310 can return to an original position due to the elastic member 320. For example, the elastic member 320 may be made of plastic or metal having elasticity.

In other words, when the lower end of the push button 310 is pressed by a user, the push button 310 transitions to a position with its lower end moving toward the main body 100 and its upper end moving away from the main body 100. The elastic member 320 is elastically deformed when a user presses the lower end of the push button 310. If pressure is released, the deformed elastic member 320 may restore to a natural or relaxed state and thereby the push button 310 returns to the original position.

Hereinafter, the usage and functions of the liquid additive supply device 10 according to one embodiment of the present disclosure are described with reference to FIGS. 7 and 8.

Figure 7:
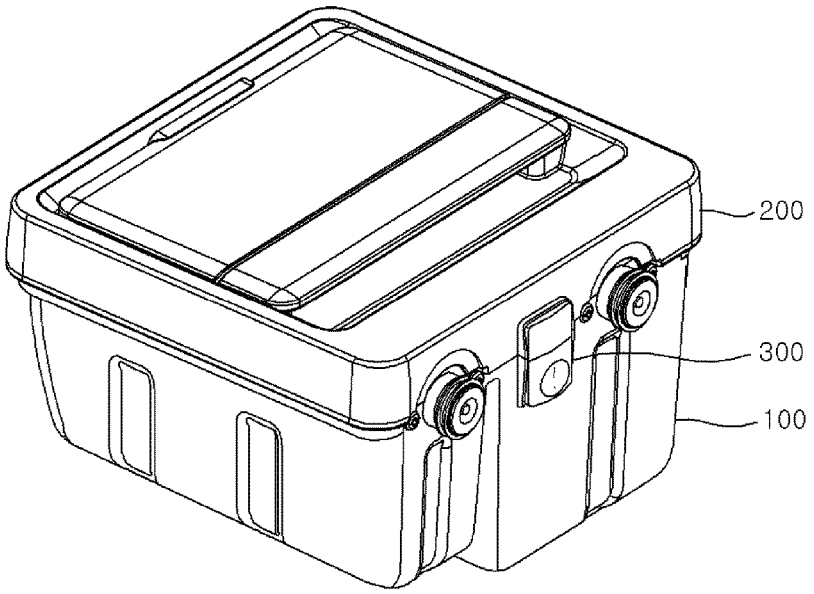
FIG. 7 illustrates an exemplary cover part being assembled to a main body through an exemplary retainer of the liquid additive supply device for a washing machine according to one embodiment of the present disclosure.

FIG. 7 illustrates a state in which the cover part is locked in the main body through the retainer of the exemplary liquid additive supply device for a washing machine according to one embodiment of the present disclosure. FIG. 8 illustrates a state in which the cover part is released from the locked state and ready to be removed from the main body according to one embodiment of the present disclosure.

Figure 8:
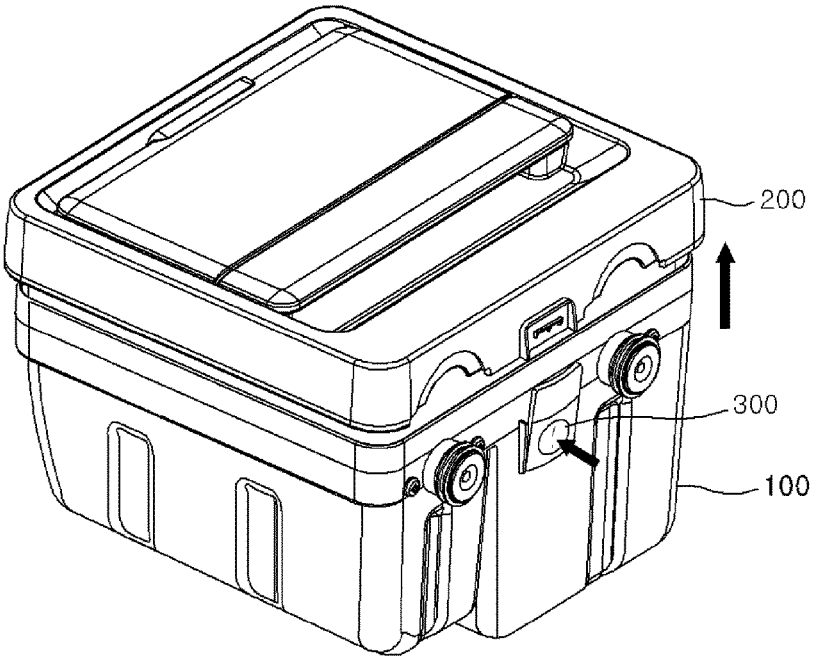
FIG. 8 illustrates the cover part is released from the main body by the retainer of the liquid additive supply device for a washing machine according to one embodiment of the present disclosure.

Referring to FIGS. 7 and 8, a user may couple one side of the main body 100 to the cover part 200 by inserting the locking tab 102 of the main body 100 into the locking slot 212.

Furthermore, to couple the other side of the main body 100 to the cover part 200, a user may press the lower end of the push button 310, thereby turning the upper end of the push button 310 away from the main body 100.

Then, a user may release the push button 310, thereby allowing the seating tab 314 of the push button 310 to be seated on the seat 218 of the cover part 200. In this manner, the cover part 200 is securely coupled to the main body 100, or in a locked state.

If the cover part 200 is fixed to the main body 100 in this way, the upper portion of the main body 100 is covered by the cover part 200. This can prevent external dust or the like from entering into the main body 100. Furthermore, a user may easily remove the main body 100 from the accommodation part 2 of the detergent dispenser 1 using the knob groove 214 of the cover part 200. Since the upper portion of the main body 100 is covered by the cover part 200, it can advantageously prevent the liquid additives from flowing outward from the main body 100 in the course of removing the main body 100 from the accommodation part 2 of the detergent dispenser 1.

If a user tries to remove the cover part 200 from the main body 100 when the cover part 200 is locked to the main body 100, the user may press the lower end of the push button 310 to have the upper end of the push button 310 to rotate away from the main body 100. Consequently, the seating tab 314 of the push button 310 becomes separate or unseated from the seat 218 of the cover part 200.

Then, the user may place a hand in the knob groove 214 of the cover part 200 and lift the cover part 20 to remove.

Finally, if the pressure applied to the lower end of the push button 310 is removed, the push button 310 may return to an original position.

With the cover part 200 removed from the washing machine, the user can clean the lower surface of the main body 100 conveniently. Moreover, the filter 135 can also be removed from the main body 100 and get cleaned.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only an example in all respects. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A liquid additive supply device for a washing machine including a liquid additive dispenser having an accommodation part, the liquid additive supply device comprising:

a main body removably accommodated within the accommodation part and configured to store a liquid additive;

a cover part configured to cover a top of the main body;

a push button coupled to the main body, the push button being changed from a first position to a second position responsive to an external pressure applied on the push button;

an elastic member configured to facilitate the push button to transition from the second position to the first position responsive to a releasement of the external pressure; and an elastic member support tab formed in a lower portion of the push button, wherein the elastic member is coupled to the elastic member support tab, wherein, when the push button is at the first position, the push button is operable to securely couple the cover part to the main body, and wherein, when the push button is at the second position, the push button is operable to release the cover part from the main body.

2. The liquid additive supply device of claim 1, further comprising:

a pair of insertion slots formed at left and right sides of the push button.

3. The liquid additive supply device of claim 2, further comprising a pair of support ribs comprising insertion tabs formed at a side of the main body, wherein the insertion tabs are rotatably inserted into the insertion slots.

4. The liquid additive supply device of claim 1, further comprising:

a seating tab formed in an upper portion of the push button; and a seat formed at a side of the cover part and operable to be coupled to the seating tab when the push button is in the first position.

5. The liquid additive supply device of claim 1, wherein the push button comprises a reinforcing tab formed in a center of the push button to reinforce a mechanical strength of the push button.

6. The liquid additive supply device of claim 1, wherein the elastic member support tab has a cross shape.

7. A washing machine comprising:

a liquid additive dispenser comprising an accommodation part and a liquid additive supply device removably accommodated within the accommodation part, wherein the liquid additive supply device comprising:

a main body removably accommodated within the accommodation part and configured to store a liquid additive;

a cover part configured to cover a top of the main body;

a push button coupled to the main body, the push button being changed from a first position to a second position responsive to an external pressure applied on the push button;

an elastic member configured to facilitate the push button to transition from the second position to the first position responsive to the external pressure being released; and an elastic member support tab formed in a lower portion of the push button, wherein the elastic member is coupled to the elastic member support tab, wherein the push button at the first position is operable to securely couple the cover part to the main body, and wherein the push button at the second position is operable to release the cover part from the main body.

8. The washing machine of claim 7, wherein the liquid additive supply device further comprises:

a pair of insertion slots formed at left and right sides of the push button.

9. The washing machine of claim 8, wherein the liquid additive supply device further comprises a pair of support ribs comprising insertion tabs formed at a side of the main body, wherein the insertion tabs are rotatably inserted into the insertion slots.

10. The washing machine of claim 7, wherein the liquid additive supply device further comprises:

a seating tab formed in an upper portion of the push button; and a seat formed at a side of the cover part and operable to be coupled to the seating tab when the push button is in the first position.

* * * * *